US007085525B2

(12) United States Patent
Inaba

(10) Patent No.: US 7,085,525 B2
(45) Date of Patent: Aug. 1, 2006

(54) IMAGE FORMING UNIT HAVING POSITIONER FOR WITHSTANDING TRANSFER ROLL PRESSING FORCE

(75) Inventor: Yuichiro Inaba, Chigasaki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/018,831

(22) Filed: Dec. 22, 2004

(65) Prior Publication Data

US 2005/0249528 A1 Nov. 10, 2005

(30) Foreign Application Priority Data

May 6, 2004 (JP) ..... 2004-137607

(51) Int. Cl.
*G03G 15/16* (2006.01)

(52) U.S. Cl. ..... 399/302

(58) Field of Classification Search ..... 399/302
See application file for complete search history.

(56) References Cited

U.S. PATENT DOCUMENTS 5,983,062 A * 11/1999 Sameshima ..... 399/302

FOREIGN PATENT DOCUMENTS

JP 11030896 A * 2/1999
JP 2003-195729 A 7/2003

* cited by examiner

*Primary Examiner*—Quana Grainger
(74) *Attorney, Agent, or Firm*—Sughrue Mion, PLLC

(57) ABSTRACT

An image forming unit having image bearing body, on which a latent image is formed, and an intermediate transfer belt, onto which a toner image obtained by developing the latent image formed on the image bearing body is transferred. A primary transfer member transfers the toner image onto the intermediate transfer belt, and a plurality of rolls, across which the intermediate transfer belt is stretched, apply tension to the intermediate transfer belt. A secondary transfer backup roll, which is one of the plurality of rolls, backs up the secondary transfer by a secondary transfer roll. A pair of side frames pivotally support the primary transfer member and the plurality of rolls. A positioner, with which a contact member rotatably fitted at both ends of a shaft of the secondary transfer roll is brought into contact, is disposed at each side frame in the vicinity of the secondary transfer backup roll.

17 Claims, 9 Drawing Sheets

IMAGE FORMING UNIT HAVING POSITIONER FOR WITHSTANDING TRANSFER ROLL PRESSING FORCE

CROSS-REFERENCE TO RELATED APPLICATION

This application claims priority under 35 USC 119 from Japanese Patent Application No. 2004-137607, the disclosure of which is incorporated by reference herein.

BACKGROUND OF THE INVENTION

1. Field of the Invention

The present invention relates to an image forming unit in an image forming apparatus for forming an image by transferring a toner image.

2. Description of the Related Art

There has been known that in a conventional image forming apparatus, a transfer section including an image bearing body (i.e., a photosensitive body), a primary transfer roll, an intermediate transfer belt and the like is unified into an image forming unit, which unit is configured to be detachably attached to an image forming apparatus main body (see, for example, Japanese Patent Application Laid-Open (JP-A) No. 2003-195729). The image forming unit of this type is provided with a pair of side frames for rotatably supporting the primary transfer roll and a plurality of other rolls, wherein the intermediate transfer belt is slidably wound on the plurality of rolls so as to apply a predetermined tension to the rolls.

Furthermore, the plurality of rolls in the image forming unit include a secondary transfer backup roll for backing up secondary transfer by means of a secondary transfer roll. Specifically, the intermediate transfer belt wound around the secondary transfer backup roll and the secondary transfer roll hold a recording sheet therebetween, whereby a toner image, which has been primarily transferred onto the intermediate transfer belt, is secondarily-transerred onto the recording sheet.

Consequently, the secondary transfer roll is adapted to press the intermediate transfer belt wound around the secondary transfer backup roll by a significantly great pressing force. Therefore, there is a possibility that an inconvenience such as a deficient image quality or the like occurs unless the image forming unit is equipped with strength resistible to the pressing force.

SUMMARY OF THE INVENTION

In view of the above-described problem experienced in the prior art, an object of the present invention is to provide an image forming unit equipped with strength satisfactorily resistible to the pressing force of a secondary transfer roll.

According to a first feature of the invention, an image forming unit comprises: an image bearing body, on which a latent image is formed; an intermediate transfer belt, onto which a toner image obtained by developing the latent image formed on the image bearing body is transferred; a primary transfer member for transferring the toner image onto the intermediate transfer belt; a plurality of rolls, across which the intermediate transfer belt is stretched, for applying tension to the intermediate transfer belt; a secondary transfer backup roll, which is one of the plurality of rolls, for backing up secondary transfer by a secondary transfer roll; and a pair of side frames for pivotally supporting the primary transfer member and the plurality of rolls, wherein a positioner, with which a contact member rotatably fitted at both ends of a shaft of the secondary transfer roll is brought into contact, is formed at each side frame in the vicinity of the secondary transfer backup roll.

According to the present feature, a positioner (a positioning portion), with which the contact member rotatably fitted at both ends of the shaft of the secondary transfer roll is brought into contact, is formed at the side frame in the vicinity of the secondary transfer backup roll. Therefore, it is possible to suitably receive the pressing force of the secondary transfer roll. Furthermore, as the positioner is formed at a portion of the side frame in the vicinity of the secondary transfer backup roll, a distortion region, which may be generated by the contact of the secondary transfer roll on the side frame, is narrowed. Consequently, it is possible to stabilize a nip pressure generated between the secondary transfer roll and the secondary transfer backup roll.

According to a second feature of the invention, the positioner is formed in such a manner that an angle formed by a marginal edge of the positioner in contact with the contact member and a virtual line connecting the center of the shaft of the secondary transfer backup roll to the center of the shaft of the secondary transfer roll becomes acute, as viewed sideways.

According to the present feature, the positioner is formed in such a manner that an angle formed by a marginal edge of the positioner in contact with the contact member and a virtual line connecting the center of the shaft of the secondary transfer backup roll to the center of the shaft of the secondary transfer roll becomes acute, as viewed sideways. As a consequence, it is possible to stabilize the contact (abutment) by the contact member with respect to the positioner.

According to a third feature of the invention, the secondary transfer backup roll is constituted of a shaft and a rotary portion rotatable around the shaft, wherein the shaft is screwed on the side frame.

According to the present feature, since the secondary transfer backup roll is constituted of a shaft and a rotary portion rotating on the shaft, and further, the shaft is screwed on the side frame, the side frame can be firmly tightened by the secondary transfer backup roll. Consequently, the rigidity of the positioner can be enhanced, and further, vibration, which may occur at a motor or a gear for driving the secondary transfer roll, will be hardly transmitted. As a consequence, a quality of an image can be improved.

According to a fourth feature of the invention, each positioner is proximate to a boss for supporting the shaft of the secondary transfer backup roll.

According to the present feature, the positioner is proximate to a boss for supporting the shaft of the secondary transfer backup roll. Therefore, the thickness of the positioner can be secured, so that the rigidity of the positioner can be enhanced. As a consequence, the side frame is hardly distorted even in the case of the contact of the secondary transfer roll, thereby stabilizing a nip pressure generated between the secondary transfer roll and the secondary transfer backup roll.

Incidentally, it is more preferable that the positioner and the boss should be continuous to each other in thickness more than the side frame.

According to a fifth feature of the invention, the secondary transfer backup roll and the image bearing body are arranged in the proximity of each other.

According to the present feature, since the secondary transfer backup roll and the image bearing body are arranged in the proximity of each other, the distortion of the side frame can be reduced, thereby stabilizing the nip pressure generated between the secondary transfer roll and the secondary transfer backup roll.

According to a sixth feature of the invention, a lap-out roll for lapping the intermediate transfer belt around the image bearing body in cooperation with a lap-in roll is provided between the secondary transfer backup roll and the image bearing body.

According to the present feature, the lap-out roll for lapping the intermediate transfer belt around the image bearing body in cooperation with the lap-in roll is interposed between the secondary transfer backup roll and the image bearing body. Therefore, it is possible to further reduce the distortion of the side frame. As a consequence, it is possible to stabilize the nip pressure generated between the secondary transfer roll and the secondary transfer backup roll.

According to a seventh feature of the invention, a bearing disposed in the secondary transfer backup roll and a bearing disposed in the lap-out roll are set off in an axial direction.

According to the present feature, the bearing disposed in the secondary transfer backup roll and the bearing disposed in the lap-out roll are set off in the axial direction. Therefore, it is possible to dispose the secondary transfer backup roll and the lap-out roll in the proximity of each other. As a consequence, it is possible to reduce the distortion of the side frame, so as to stabilize the nip pressure generated between the secondary transfer roll and the secondary transfer backup roll.

DETAILED DESCRIPTION OF THE INVENTION

Figure 1:
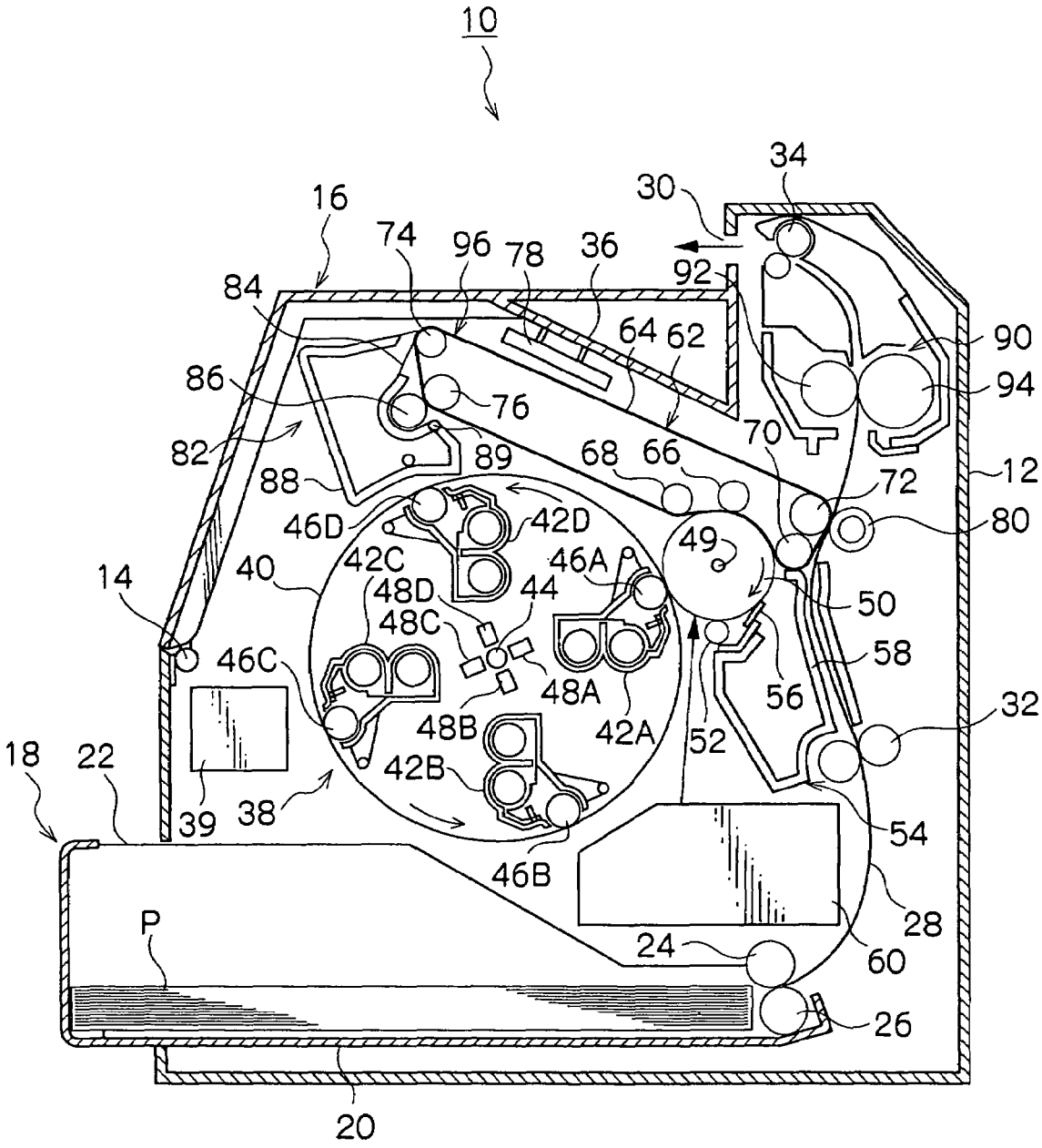
FIG. 1 is a side view schematically showing an image forming apparatus having an image forming unit according to the invention.

A description will be given below of a preferred embodiment according to the present invention in reference to the attached drawings. As shown in FIG. 1, an image forming apparatus 10 is provided with an image forming apparatus main body 12. An opening/closing cover 16 turnable on a turning fulcrum 14 is disposed at the upper portion of the image forming apparatus main body 12. A sheet feed unit 18 of, for example, one stage is disposed in the lower portion of the image forming apparatus main body 12.

The sheet feed unit 18 includes a sheet feed unit main body 20 and a sheet feed cassette 22 containing recording sheets P therein. At the upper portion in the vicinity of a deep end of the sheet feed cassette 22, there are provided a feed roll 24 for supplying the recording sheets P from the sheet feed cassette 22 and a retard roll 26 for separating the recording sheets P to be supplied one by one.

A transportation path 28 is a passage for the recording sheet P traveling from the feed roll 24 to a discharge port 30. The transportation path 28 is formed substantially vertically from the sheet feed unit 18 to a fixing device 90, described later, in the vicinity of the back side of the image forming apparatus main body 12 (i.e., on a right side in FIG. 1). A secondary transfer roll 80 and a secondary transfer backup roll 72, which will be described later, are arranged upstream of the fixing device 90 on the transportation path 28. Upstream of the secondary transfer roll 80 and the secondary transfer backup roll 72 are disposed registration rolls 32. Moreover, discharge rolls 34 are disposed in the vicinity of the discharge port 30 on the transportation path 28.

In view of this, the recording sheets P fed out from the sheet feed cassette 22 in the sheet feed unit 18 by the feed roll 24 are separated by the retard roll 26, and then, only an uppermost recording sheet P is introduced onto the transportation path 28. The recording sheet P is temporarily stopped by the registration rolls 32, and then, passes between the secondary transfer roll 80 and the secondary transfer backup roll 72 while taking a timing, whereby a toner image is transferred onto the recording sheet P. Thereafter, the transferred toner image is fixed by the fixing device 90, and then, is discharged from the discharge port 30 to a discharge unit 36 disposed on the opening/closing cover 16 by the discharge rolls 34.

The discharge unit 36 is low at the portion of the discharge port, and thus, is gradually elevated forward (i.e., leftward in FIG. 1).

At, for example, substantially the center in the image forming apparatus main body 12 is disposed a rotary developing device 38. In front of the rotary developing device 38 (i.e., on a left side in FIG. 1) is disposed a controller 39 for controlling respective component parts constituting the image forming apparatus 10.

The rotary developing device 38 includes developers 42A to 42D for forming toner images of four colors, i.e., yellow, magenta, cyan and black, inside of a rotating member 40, and is designed to be rotated leftward (counterclockwise in FIG. 1) on a rotary shaft 44. The developers 42A to 42D are provided with developing rolls 46A to 46D, respectively, and are pressed in a normal direction of the rotating member 40 by, for example, resilient members 48A to 48D such as a coil spring.

An image bearing body 50, which is rotated on, for example, a rotary strut 49 and consists of a photosensitive body, is arranged in contact with the rotary developing device 38. The developing rolls 46A to 46D project at a part of each of the developing rolls 46A to 46D by, for example, 2 mm in a radial direction from the outer periphery of the rotating member 40 in a state not in contact with the image bearing body 50.

Tracking rolls, not shown, each having a diameter slightly greater than that of each of the developing rolls 46A to 46D are disposed in such a manner as to be rotated coaxially with the developing rolls 46A to 46D at both ends of each of the developing rolls 46A to 46D.

In other words, the developers 42A to 42D are arranged on the outer periphery of the rotating member 40 at an angular interval of 90° therebetween on the rotary shaft 44, and further, the respective tracking rolls of the developing rolls 46A to 46D are brought into contact with flanges (not shown) disposed at both ends of the image bearing body 50. A latent image on the image bearing body 50 is thus developed with toners of respective colors while forming predetermined clearances between the developing rolls 46A to 46D and the image bearing body 50, respectively.

Under the image bearing body 50 is provided a charging device 52, which uniformly charges the image bearing body 50 and consists of, for example, a charging roll. Moreover, in the image bearing body 50, there is provided a cleaner 54 for the image bearing body in such a manner as to suspend from the rotary strut 49, wherein the image bearing body 50 and the cleaner 54 for the image bearing body are integrated with each other.

The cleaner 54 for the image bearing body is constituted of a cleaning blade 56 for scraping a waste toner remaining on the image bearing body 50 after, for example, primary transfer and a toner recycle bottle 58 for recycling the waste toner scraped by the cleaning blade 56.

Here, a rib or the like is formed behind the toner recycle bottle 58 (i.e., right in FIG. 1) in a curve in such a manner as to smoothly transport the recording sheet P, and thus, constitutes a part of the transportation path 28.

On the lower back side of the rotary developing device 38, there is provided an exposing device 60 for writing the latent image with a light beam such as a laser beam in the image bearing body 50 charged by the charging device 52. In the meantime, above the rotary developing device 38, there is provided an intermediate transfer device 62 for transporting a toner image visualized by the rotary developing device 38 from a primary transfer position to a secondary transfer position.

The intermediate transfer device 62 includes an intermediate transfer belt 64 serving as an intermediate transfer member, a primary transfer roll 66, a lap-in roll 68, a lap-out roll 70, the secondary transfer backup roll 72, a scraper backup roll 74 and a brush backup roll 76. The intermediate transfer belt 64 is equipped with, for example, elasticity, and thus, is stretched with substantial flatness in such a manner as to form a long side and a short side above the rotary developing device 38.

The upper long side of the intermediate transfer belt 64 is stretched substantially in parallel to, for example, the discharge unit 36 disposed above the image forming apparatus main body 12. The intermediate transfer belt 64 has a primary transfer portion (i.e., an image bearing body lap region) in lapping contact with the image bearing body 50 between the lap-in roll 68 disposed upstream of the primary transfer roll 66 and the lap-out roll 70 disposed downstream of the primary transfer roll 66 under the long side of the intermediate transfer belt 64, and thus, laps on the image bearing body 50 only within a predetermined range, to thereby follow the rotation of the image bearing body 50.

Consequently, the toner image on the image bearing body 50 is primarily transferred onto the intermediate transfer belt 64 in superimposition in order of, for example, yellow, magenta, cyan and black by the primary transfer roll 66, and thereafter, the primarily transferred toner image is transported to the secondary transfer roll 80, described later. At this time, the lap-in roll 68 and the lap-out roll 70 are separated from the image bearing body 50.

In this manner, the intermediate transfer belt 64 is stretched across the five rolls, that is, the lap-in roll 68, the lap-out roll 70, the secondary transfer backup roll 72, the scraper backup roll 74 and the brush backup roll 76, and therefore, the toner image on the image bearing body 50 is transferred by the primary transfer roll 66.

Furthermore, on the back side of the intermediate transfer belt 64 (i.e., on the right side in FIG. 1), a flat portion (i.e., the short side) is defined by the lap-out roll 70 and the secondary transfer backup roll 72. The flat portion is configured to serve as a secondary transfer unit in such a manner as to expose to the transportation path 28. Here, in the secondary transfer unit, the lap-out roll 70 is arranged in such a manner that an angle of, for example, 120 is formed between the intermediate transfer belt 64 and the transportation path 28.

The scraper backup roll 74 backs up a scraper 84, described later, in scraping the waste toner remaining on the intermediate transfer belt 64 after the secondary transfer. Additionally, the brush backup roll 76 backs up a brush roll 86, described later, in scraping the waste toner remaining on the intermediate transfer belt 64 after the secondary transfer.

A sensor 78 such as a reflection type photo sensor is fixed to the reverse (i.e., inside) of the opening/closing cover 16 above the long side of the intermediate transfer belt 64. The sensor 78 reads a patch of a toner formed on the intermediate transfer belt 64, detects the position of the intermediate transfer belt 64 in a rotating direction, and detects the density of the toner.

The secondary transfer backup roll 72 in the intermediate transfer device 62 faces the secondary transfer roll 80 while holding the transportation path 28 between the rolls 72 and 80. In other words, a clearance between the secondary transfer roll 80 and the secondary transfer backup roll 72 serves as a secondary transfer position in the secondary transfer unit. Thus, the secondary transfer roll 80 secondarily transfers, onto the recording sheet P, the toner image primarily transferred onto the intermediate transfer belt 64 at the secondary transfer position by the backup of the secondary transfer backup roll 72.

Here, the secondary transfer roll 80 is separated from the intermediate transfer belt 64 during the rotation of the intermediate transfer belt 64 three times, that is, during the transportation of the toner image of the three colors, i.e., yellow, magenta and cyan. As soon as the black toner image is transferred, the secondary transfer roll 80 is configured to be brought into contact with the intermediate transfer belt 64.

Incidentally, a predetermined potential difference is configured to be generated between the secondary transfer roll 80 and the secondary transfer backup roll 72. For example, in the case of the high voltage at the secondary transfer roll 80, the secondary transfer backup roll 72 is connected to a ground (abbreviated as "a GND") or the like.

At the end of the intermediate transfer belt 64 on a side opposite to the image bearing body 50 is disposed a cleaner 82 for an intermediate transfer member in a contact manner. The cleaner 82 for an intermediate transfer member includes the scraper 84, the brush roll 86, a toner recycle bottle 88 and a rotary strut 89. The cleaner 82 for an intermediate transfer member is designed to be oscillated on the rotary strut 89. The scraper 84 scrapes the waste toner remaining on the intermediate transfer belt 64 after, for example, the secondary transfer, followed by cleaning. The brush roll 86 is adapted to further scrape the waste toner remaining after the cleaning by the scraper 84. The toner recycle bottle 88 serves to recycle the toner scraped by the scraper 84 and the brush roll 86.

The scraper 84 is made of, for example, a thin stainless plate, and receives a voltage of a polarity reverse to that of the toner. The brush roll 86 is a brush made of acryl or the like which has been subjected to, for example, a conductive process. The scraper 84 and the brush roll 86 are such configured as to be separated from the intermediate transfer belt 64 during the transportation of the toner image by the intermediate transfer belt 64 while to be integrally brought into contact with the intermediate transfer belt 64 at a predetermined timing.

Here, the intermediate transfer device 62, the image bearing body 50, the charging device 52, the cleaner 54 for the image bearing body and the cleaner 82 for an intermediate transfer member are integrated with each other, thereby constituting a part of an image forming unit 96, described later.

Above the secondary transfer position is arranged the fixing device 90. The fixing device 90 includes a heating roll 92 and a pressurizing roll 94. The fixing device 90 is adapted to fix, onto the recording sheet P, the toner image secondarily transferred onto the recording sheet P by the secondary transfer roll 80 and the secondary transfer backup roll 72, and thereafter, to transport the recording sheet P toward the discharge rolls 34.

Figure 2:
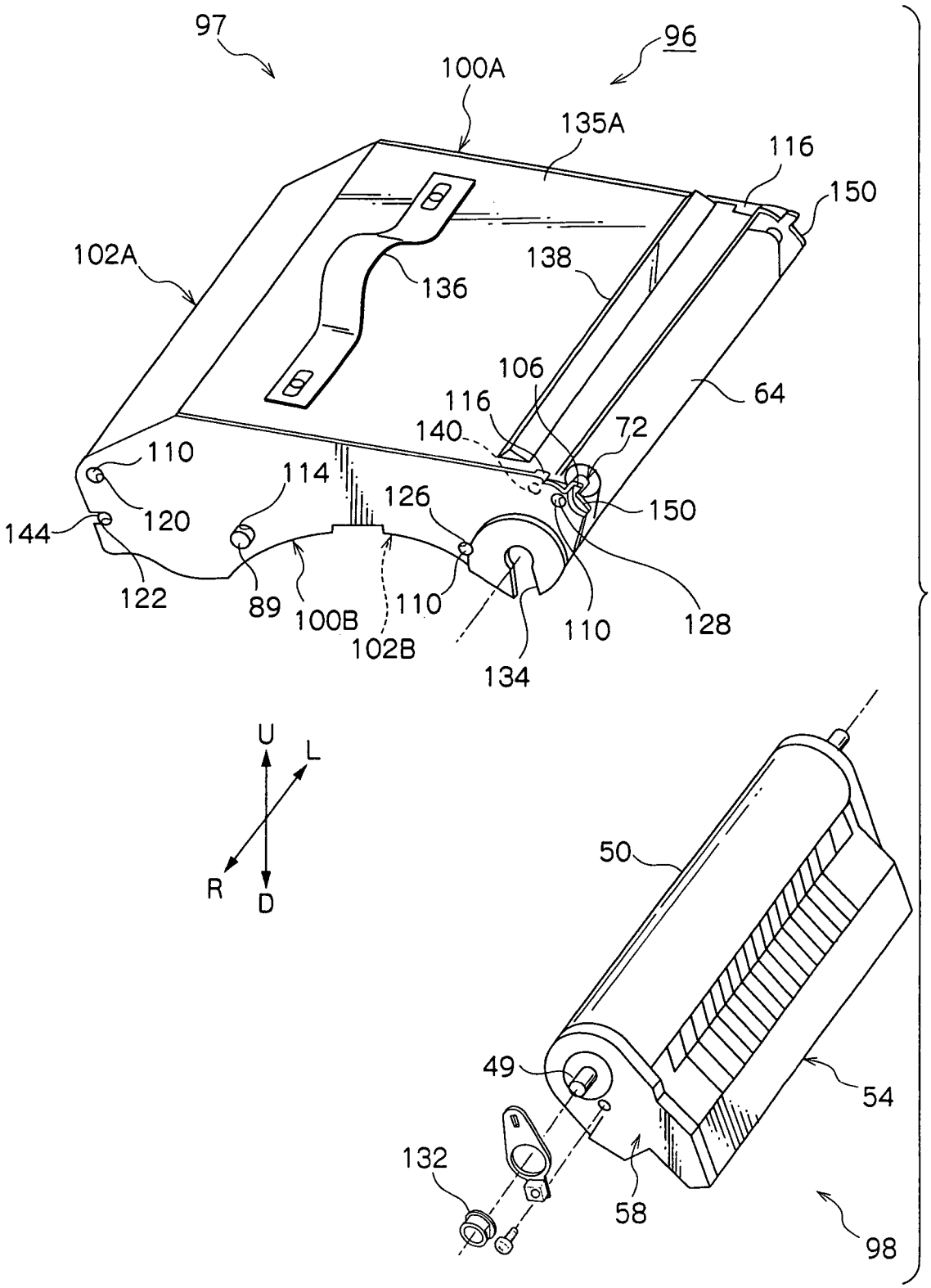
FIG. 2 is a perspective view schematically showing the image forming unit.
Figure 3:
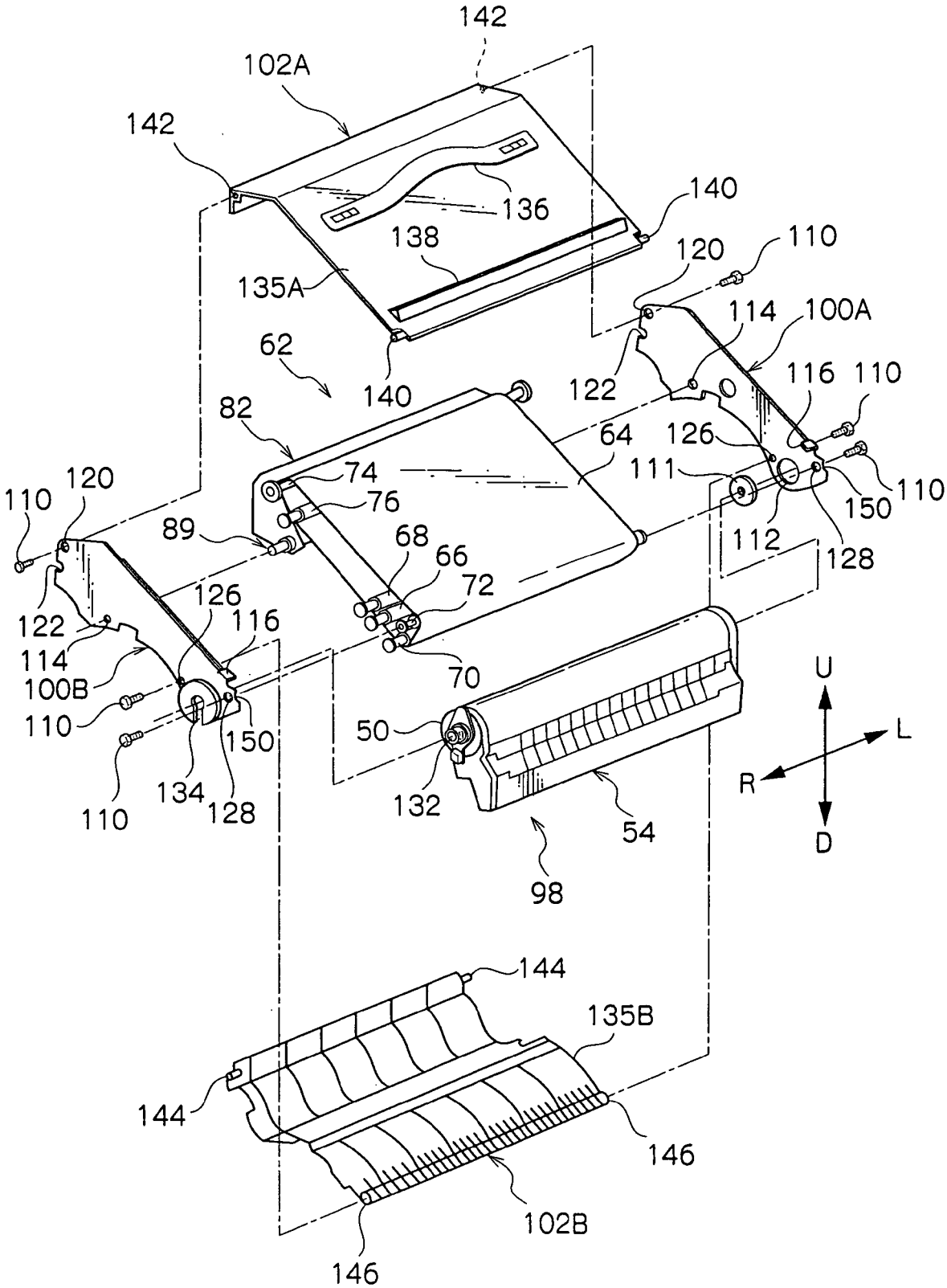
FIG. 3 is an exploded perspective view schematically showing the image forming unit.

As shown in FIGS. 2 and 3, the image forming unit 96 is configured by integrating a pair of side frames 100A and 100B disposed laterally (indicated by arrows L and R), a pair of protective covers 102A and 102B disposed vertically (indicated by arrows U and D), the intermediate transfer device 62, the image bearing body 50, the charging device 52, the cleaner 54 for the image bearing body and the cleaner 82 for an intermediate transfer member together.

Here, the side frames 100A and 100B, the protective covers 102A and 102B, the intermediate transfer device 62 and the cleaner 82 for an intermediate transfer member are integrated together, thereby constituting an intermediate transfer assembly 97; in the meantime, the image bearing body 50, the charging device 52 and the cleaner 54 for the image bearing body are integrated together, thereby constituting an image bearing body unit 98.

Namely, the image bearing body unit 98 is incorporated in the intermediate transfer assembly 97 via a bearing 111 and another bearing 132, thus configuring the image forming unit 96.

The image bearing body unit 98 is detachably attached to the intermediate transfer assembly 97. When the image bearing body unit 98 is disposed in the intermediate transfer assembly 97, a predetermined tension is applied to the intermediate transfer belt 64 by winding the intermediate transfer belt 64 stretched across the lap-in roll 68 and the lap-out roll 70 around the image bearing body 50 only within a predetermined range, thereby forming a primary transfer section between the image bearing body 50 and the intermediate transfer belt 64.

The intermediate transfer belt 64 is supported in such a manner as to be turned via the five rolls: the secondary transfer backup roll 72, the lap-in roll 68, the lap-out roll 70, the scraper backup roll 74 and the brush backup roll 76. The toner image borne on the image bearing body 50 is transferred by the primary transfer roll 66.

Bearings 104 are disposed at both ends of each of the primary transfer roll 66, the lap-in roll 68, the lap-out roll 70, the scraper backup roll 74 and the brush backup roll 76, which rolls are supported by the side frames 100A and 100B via the bearings 104.

The secondary transfer backup roll 72 includes a shaft 106 and a rotating portion 108, which is rotated on the shaft 106. At both ends of the rotating portion 108 are provided bearings 105 (see FIG. 9). Furthermore, in the secondary transfer backup roll 72, both ends of the shaft 106 are fixed to the side frames 100A and 100B via fixing members 110 such as screws, respectively.

At the side frame 100A are formed a hole 112, which allows the rotary strut 49 of the image bearing body 50 to penetrate therethrough and supports one end of the rotary strut 49 via the bearing 111, and another hole 114, which allows the rotary strut 89 of the cleaner 82 for an intermediate transfer member to penetrate therethrough. The rotary strut 49 and the rotary strut 89 are designed to project sideways.

At the upper portion of the side frame 100A on the side of the image bearing body 50 is formed a recess 116, into which projections 140 formed at the protective cover 102A are fitted, and further, at the upper portion of the side frame 100A on the side of the cleaner 82 for an intermediate transfer member is formed a hole 120, into which a stationary portion 142 formed at the protective cover 102A is secured by the fixing member 110. Moreover, at the lower portion of the side frame 100A on the side of the cleaner 82 for an intermediate transfer member is formed a recess 122, into which a projection 144 formed at the protective cover 102B is fitted, and further, at the lower portion of the side frame 100A on the side of the image bearing body 50 is formed a hole 126 secured by the protective cover 102B.

At the side frame 100A is disposed a fixing portion 128 for fixing one end of the shaft 106 of the secondary transfer backup roll 72 via the fixing member 110. Inside of the side frame 100A is a receiving portion, not shown, for supporting one end of each of the lap-in roll 68, the lap-out roll 70, the scraper backup roll 74 and the brush backup roll 76 sideways via the bearing 104.

Incidentally, one end of the primary transfer roll 66 is supported by the side frame 100A via the bearing 104 and a holding tool, not shown.

At the side frame 100B are formed a cutout 134, which allows the rotary strut 49 of the image bearing body 50 to pass therethrough and supports one end of the rotary strut 49 via the bearing 132, and another hole 114, which allows the rotary strut 89 of the cleaner 82 for an intermediate transfer member to pass therethrough, wherein the rotary strut 49 and the rotary strut 89 are designed to project sideways.

Here, the cutout 134 is formed such that a portion thereof, through which the rotary strut 49 is passed, is narrower than another portion thereof, to which the bearing 132 is fixed. The bearing 132 is secured to the side frame 100B via the fixing member such as a screw, not shown.

At the upper portion of the side frame 100B on the side of the image bearing body 50 is formed a recess 116, into which a projection 140 formed at the protective cover 102A is fitted, and further, at the upper portion of the side frame 100B on the side of the cleaner 82 for an intermediate transfer member is a formed hole 120, into which the stationary portion 142 of the protective cover 102A is secured by the fixing member 110.

Moreover, at the lower portion of the side frame 100B on the side of the cleaner 82 for an intermediate transfer member is formed a recess 122, into which a projection 144 formed at the protective cover 102B is fitted, and further, at the lower portion of the side frame 100B on the side of the image bearing body 50 is formed a hole 126, into which a stationary portion 146 formed at the protective cover 102B is secured by the fixing member 110.

At the side frame 100B is disposed a fixing portion 128 for fixing one end of the shaft 106 of the secondary transfer backup roll 72 via the fixing member 110. Inside of the side frame 100B is a receiving portion, not shown, for supporting one end of each of the lap-in roll 68, the lap-out roll 70, the scraper backup roll 74 and the brush backup roll 76 sideways via the bearing 104.

Incidentally, one end of the primary transfer roll 66 is supported by the side frame 100B via the bearing 104 and a holding tool, not shown.

The protective cover 102A includes a cover main body 135A, a grip 136, a protrusion 138, the projections 140 and the stationary portions 142. The cover main body 135A is made of, for example, an ABS resin or the like, and has elasticity, so as to cover the upper portions of the intermediate transfer belt 64 and the cleaner 82 for an intermediate transfer member. The grip 136 is made of, for example, a flexible member, and is attached to the upper surface of the cover main body 135A in such a manner that an operator can grip the image forming unit 96.

The protrusion 138 is formed integrally with, for example, the cover main body 135A, and projects to expose to the fixing device 90, so as to prevent foreign matters placed on the cover main body 135A from being intruded into the image forming apparatus main body 12. The projections 140 are fitted into the recesses 116 formed at the side frames 100A and 10B, respectively. The stationary portions 142 are fitted into the holes 120 formed at the side frames 100A and 100B via the fixing members 110, respectively.

The protective cover 102B includes a cover main body 135B, the projections 144 and the stationary portions 146. The cover main body 135B is made of, for example, an ABS resin or the like, has elasticity, and is curved in such a manner as to cover the lower portions of the intermediate transfer belt 64 and the cleaner 82 for an intermediate transfer member. The projections 144 are fitted into the recesses 122 formed at the side frames 100A and 100B, respectively. The stationary portions 146 are fitted into the holes 126 formed at the side frames 100A and 100B via the fixing members 110, respectively.

The side frames 100A and 100B are arranged substantially in parallel to a rotating direction of the image bearing body 50 and the intermediate transfer belt 64, and further, are connected to each other at three points via the protective covers 102A and 102B for covering the upper and lower portions of the intermediate transfer belt 64, respectively, and the shaft 106 of the secondary transfer backup roll 72. In this manner, the component parts constituting the image forming unit 96 are aligned relatively to each other, and further, the image bearing body 50, the intermediate transfer device 62 and the cleaner 82 for an intermediate transfer member are covered from the side.

Figure 4:
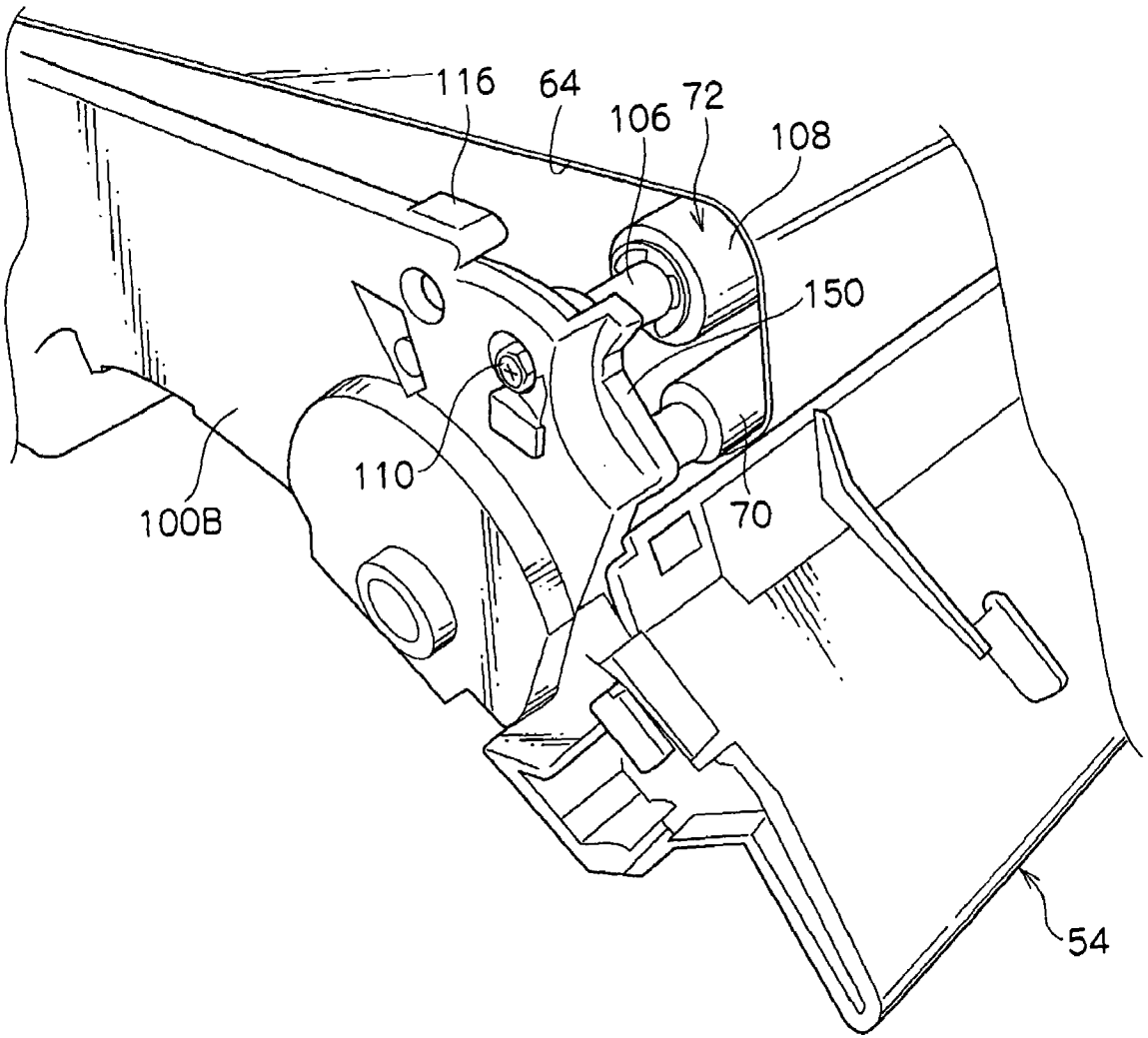
FIG. 4 is a perspective view schematically showing a positioner in the image forming unit.
Figure 5:
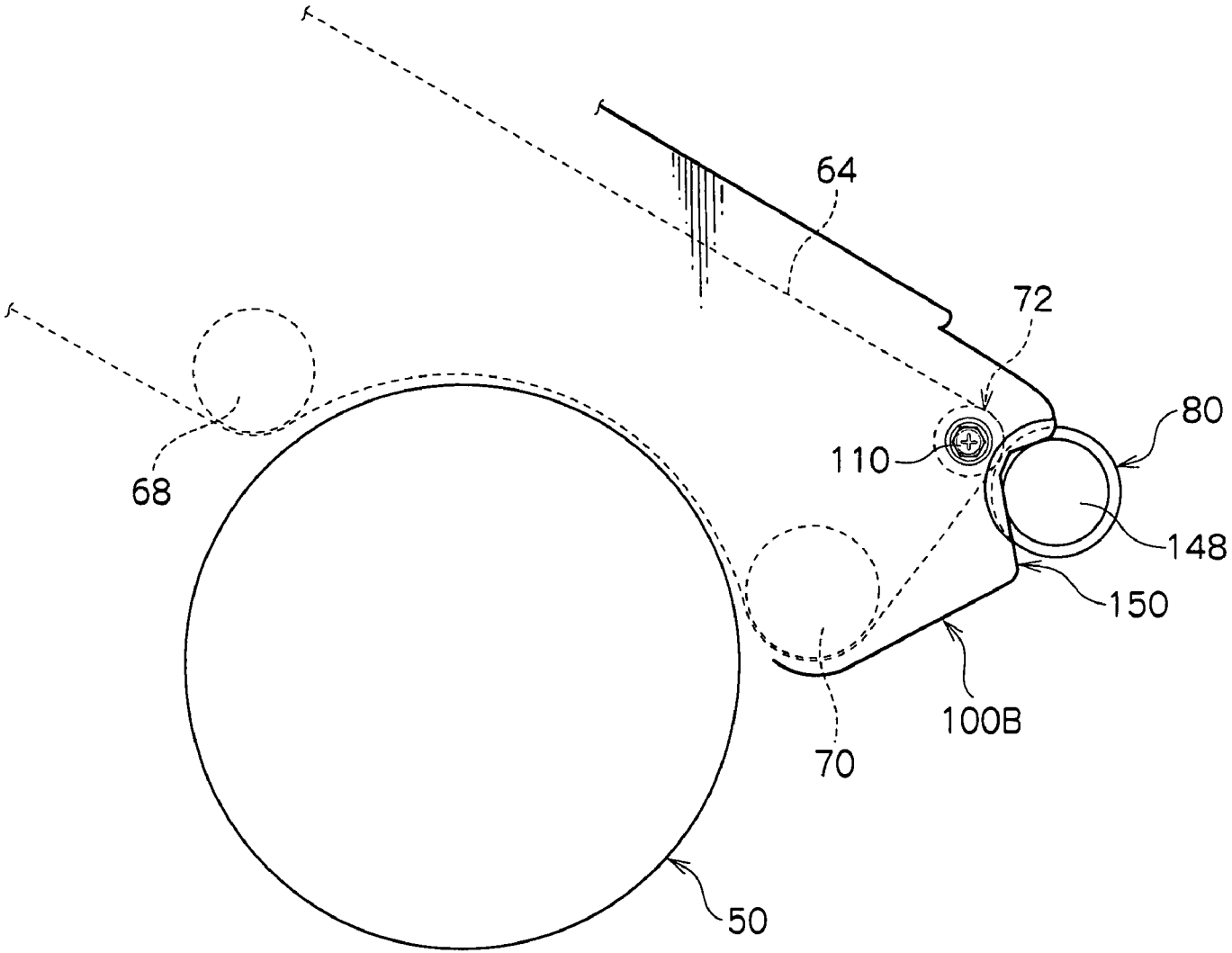
FIG. 5 is a side view schematically showing the positioner in the image forming unit.

Since in the image forming unit 96, the shaft 106 of the secondary transfer backup roll 72 is screwed at both ends thereof to the side frames 100A and 100B via the fixing members 110, respectively, the vicinity of the secondary transfer position of the intermediate transfer belt 64 can be exposed in a stable state. That is to say, as shown in FIGS. 4 and 5, a positioner 150, with which each of disk-like contact members 148 rotatably fitted at both ends of the shaft of the secondary transfer roll 80 is brought into contact, is formed at each of the side frames 100A and 100B in the vicinity of the secondary transfer position.

Figure 6:
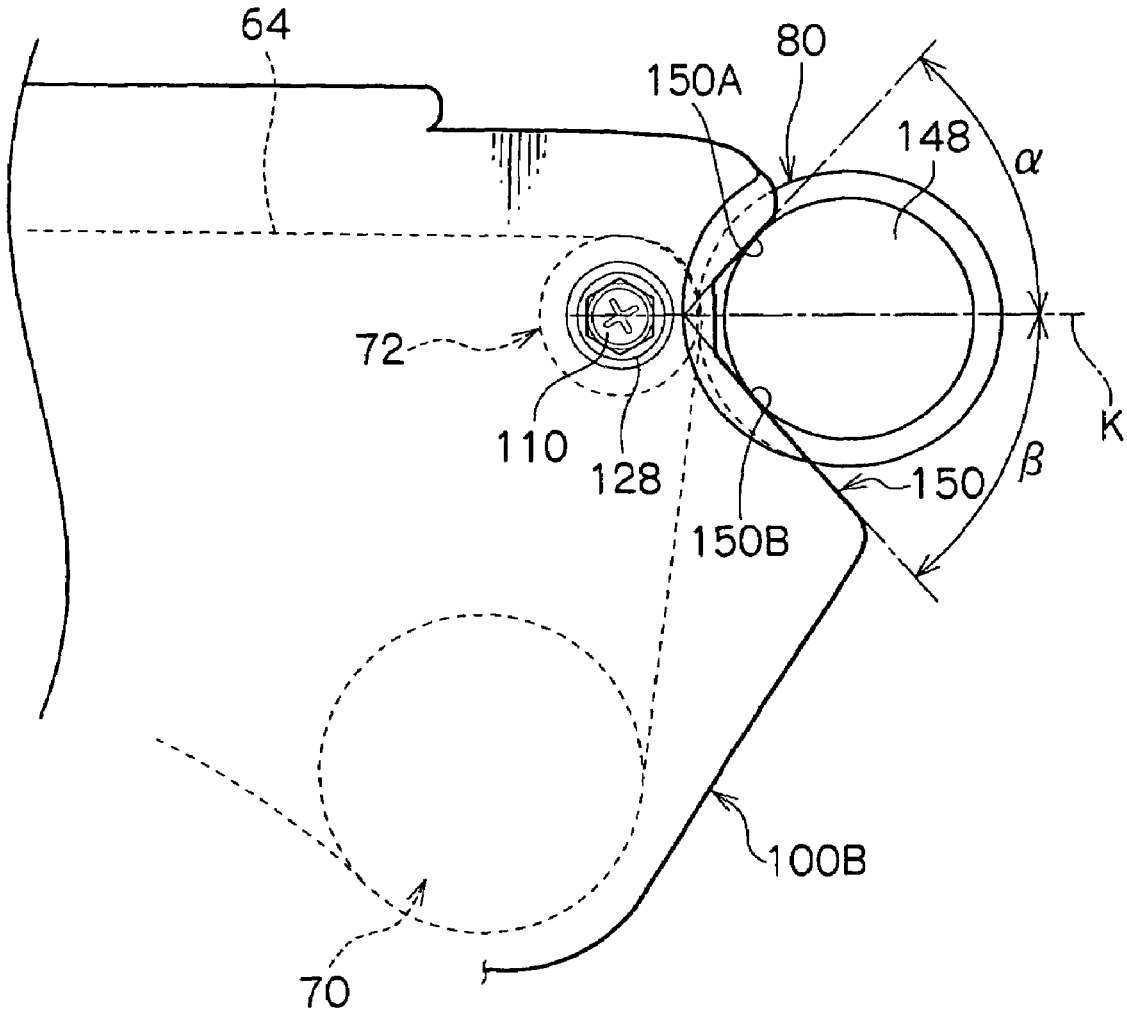
FIG. 6 is an explanatory diagram showing the positional relationship between the positioner and a contact member in the image forming unit.

As viewed sideways in FIG. 6, the positioner 150 is formed in a substantial V shape having acute angles $\alpha$ and $\beta$ formed by a virtual line K connecting the center of the fixing member 110 screwing the secondary transfer backup roll 72 (i.e., the centers of the shaft 106 and the fixing portion 128) to the center of the shaft of the secondary transfer roll 80 and marginal edges 150A and 150B of the positioner 150 (of the side frames 100A and 100B) in contact with the contact member 148, respectively. As a consequence, the contact (i.e., the abutment) of the contact member 148 with respect to the positioner 150 can be stabilized.

Naturally, the contact member 148 cannot be rotated when it is pressed to the positioner 150, and therefore, only the secondary transfer roll 80 is rotated.

Figure 7:
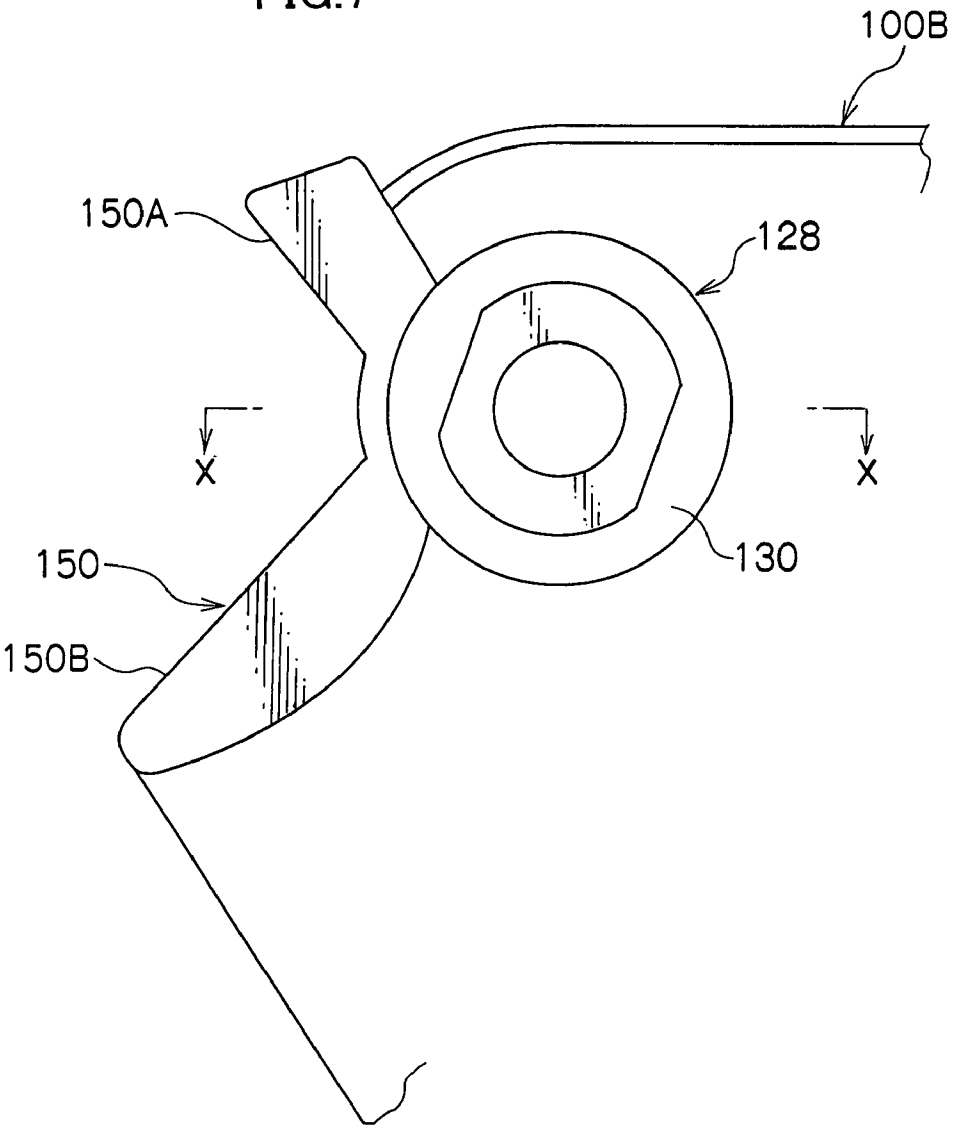
FIG. 7 is a side view schematically showing the positioner in the image forming unit, as viewed from the inside.
Figure 8:
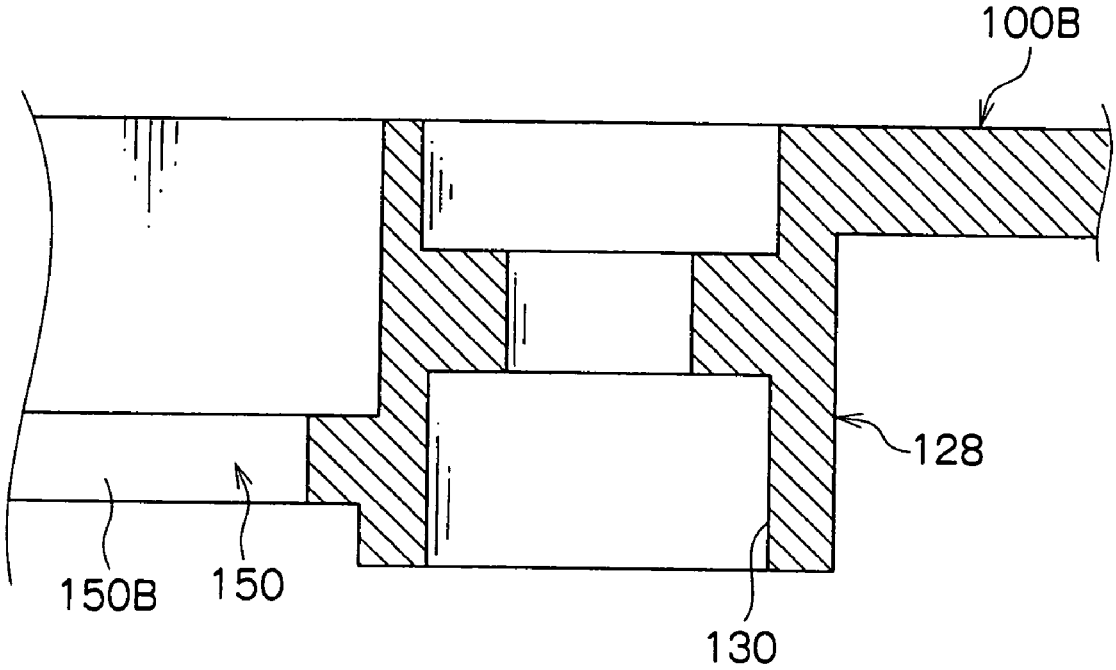
FIG. 8 is a cross-sectional view taken along a line X—X of FIG. 7.

As shown in FIGS. 7 and 8, the fixing portion 128 for screwing the shaft 106 of the secondary transfer backup roll 72 serves as a boss 130 having a predetermined height (i.e., a predetermined thickness). The boss 130 is formed continuously to the positioner 150. Thus, it is possible to satisfactorily secure the thickness of the positioner 150.

Next, description will be made on the function of the image forming apparatus 10 having the above-described configuration. When an image forming signal is transmitted to the image forming apparatus 10, the image bearing body 50 is uniformly charged by the charging device 52, and then, a light beam is emitted from the exposing device 60 to the charged image bearing body 50 in response to the image signal. The surface of the image bearing body 50 is exposed to the light beam emitted from the exposing device 60, so that a latent image is formed thereon.

The toner image consisting of yellow, magenta, cyan and black, developed by the rotary developing device 38, from the latent image formed on the image bearing body 50 by the exposing device 60 is superimposed on the intermediate transfer belt 64 (the primary transfer). The waste toner remaining on the image bearing body 50 is scraped and recycled by the cleaner 54 for the image bearing body during the primary transfer.

In the meantime, the recording sheets P contained in the sheet feed cassette 22 are fed out by the feed roll 24 in response to a sheet feed signal or the like, are separated from each other by the retard roll 26, are introduced onto the transportation path 28, are temporarily stopped by the registration rolls 32, and then, are introduced into between the secondary transfer roll 80 and the secondary transfer backup roll 72 while taking a timing.

When the recording sheet P is introduced into between the secondary transfer roll 80 and the secondary transfer backup roll 72, the toner image primarily transferred onto the intermediate transfer belt 64 is secondarily transferred onto the recording sheet P by the secondary transfer roll 80 and the secondary transfer backup roll 72. The waste toner remaining on the intermediate transfer belt 64 after the secondary transfer is scraped and recycled by the cleaner 82 for the intermediate transfer member.

The recording sheet P having the toner image transferred thereonto is introduced to the fixing device 90, at which the toner image is fixed under thermal pressure generated by the heating roll 92 and the pressurizing roll 94. Thereafter, the recording sheet P having the toner image fixed thereonto is discharged from the discharge port 30 by the discharge roll 34.

In the secondary transfer section, the secondary transfer roll 80 is brought into contact with the secondary transfer backup roll 72 under high pressure. At the same time, the contact members 148 rotatably fitted at both ends of the shaft of the secondary transfer roll 80 are brought into contact with the positioner 150 under high pressure. As shown in FIGS. 7 and 8, the positioner 150 is formed continuously to the boss 130 for supporting the shaft 106 of the secondary transfer backup roll 72 screwed by the fixing member 110, thereby satisfactorily securing the rigidity of the positioner 150.

Moreover, as shown in FIGS. 4 to 6, the positioner 150, with which the contact member 148 of the secondary transfer roll 80 is brought into contact, is formed at the side frames 100A and 100B in the vicinity of the portion, at which the secondary transfer backup roll 72 is securely screwed. As a result, a distortion region of the side frame 100A or 100B, generated by the contact of the secondary transfer roll 80, remarkably narrowed.

Figure 9:
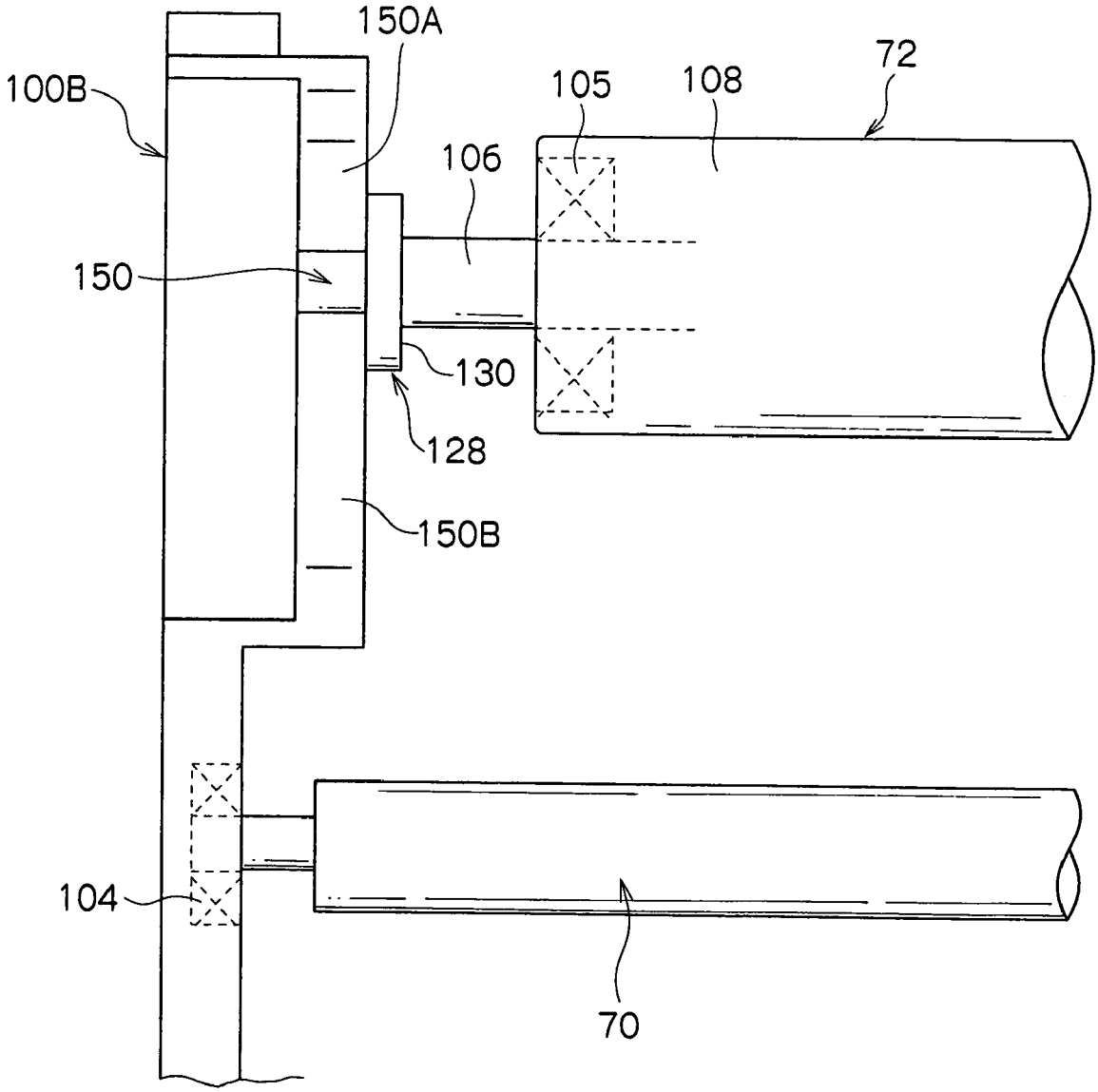
FIG. 9 is a front view schematically showing the positioner in the image forming unit.

Further, as shown in FIG. 9, since the bearing 105 disposed at the secondary transfer backup roll 72 and the bearing 104 disposed at the lap-out roll 70 are set off in the axial direction, the secondary transfer backup roll 72, the image bearing body 50 and the lap-out roll 70 for lapping the intermediate transfer belt 64 on the image bearing body 50 in cooperation with the lap-in roll 68 can be arranged in the proximity of each other, as shown in FIG. 5. Consequently, it is possible to further reduce the distortion region of the side frame 100A or 100B.

Furthermore, as viewed sideways in FIG. 6, the positioner 150 is formed in a substantial V shape having the acute angles $\alpha$ and $\beta$ formed by the virtual line K connecting the center of the fixing member 110 screwing the secondary transfer backup roll 72 (i.e., the centers of the shaft 106 and the fixing portion 128) to the center of the shaft of the secondary transfer roll 80 and the marginal edges 150A and 150B of the positioner 150 (of the side frames 100A and 100B) in contact with the contact member 148. As a consequence, the contact (i.e., the abutment) of the contact member 148 with respect to the positioner 150 can be stabilized.

Therefore, even if the secondary transfer roll 80 is brought into contact with the secondary transfer backup roll 72 by the great pressing force, the secondary transfer backup roll 72 can resist to the pressing force, thereby stabilizing a nip pressure generated between the secondary transfer roll 80 and the secondary transfer backup roll 72. Thus, deficiency in the image quality is reliably avoided in the secondary transfer section.

In addition, the shaft of the secondary transfer backup roll 72 is screwed to the side frames 100A and 100B via the fixing members 110, so that the side frames 100A and 100B can be firmly tightened by the secondary transfer backup roll 72.

Consequently, the rigidity of the positioner 150 can be enhanced in the above-described manner, thereby making it difficult to transmit the vibration occurring at the motor or gear for driving the secondary transfer roll 80 to the image forming unit 96. Thus, it is possible to further prevent generation of the deficient image quality in the secondary transfer section, so as to improve the quality of the image.

As described above, according to the invention, it is possible to provide the image forming unit equipped with the strength enough to satisfactorily resist the pressing force by the secondary transfer roll.

What is claimed is:

1. An image forming unit comprising:

an image bearing body, on which a latent image is formed;

an intermediate transfer belt, onto which a toner image obtained by developing the latent image formed on the image bearing body is transferred;

a primary transfer member for transferring the toner image onto the intermediate transfer belt;

a plurality of rolls, across which the intermediate transfer belt is stretched, for applying tension to the intermediate transfer belt;

a secondary transfer backup roll, which is one of the plurality of rolls, for backing up secondary transfer by a secondary transfer roll; and a pair of side frames for pivotally supporting the primary transfer member and the plurality of rolls, wherein a positioner, with which a contact member rotatably fitted at both ends of a shaft of the secondary transfer roll is brought into contact, is formed at each side frame in the vicinity of the secondary transfer backup roll, and the positioner is formed in such a manner that an angle formed by each of marginal edges of the positioner in contact with the contact member and a virtual line connecting the center of the shaft of the secondary transfer backup roll to the center of the shaft of the secondary transfer roll becomes acute, as viewed sideways.

2. An image forming unit according to claim 1, wherein the secondary transfer backup roll is constituted of a shaft and a rotary portion rotatable around the shaft, the shaft being screwed on the side frame.

3. An image forming unit according to claim 1, wherein each positioner is proximate to a boss for supporting the shaft of the secondary transfer backup roll.

4. An image forming unit according to claim 1, wherein the secondary transfer backup roll and the image bearing body are arranged in the proximity of each other.

5. An image forming unit according to claim 4, wherein a lap-out roll for lapping the intermediate transfer belt around the image bearing body in cooperation with a lap-in roll is provided between the secondary transfer backup roll and the image bearing body.

6. An image forming unit according to claim 5, wherein a bearing disposed in the secondary transfer backup roll and a bearing disposed in the lap-out roll are set off in an axial direction.

7. An image forming unit comprising:

an image bearing body, on which a latent image is formed;

an intermediate transfer belt, onto which a toner image obtained by developing the latent image formed on the image bearing body is transferred;

a primary transfer member for transferring the toner image onto the intermediate transfer belt;

a plurality of rolls, across which the intermediate transfer belt is stretched, for applying tension to the intermediate transfer belt;

a secondary transfer backup roll for backing up secondary transfer, so as to transfer, onto a sheet, the toner image transferred onto the intermediate transfer belt; and a pair of side frames for pivotally supporting the primary transfer member, the plurality of rolls and the secondary transfer backup roll, wherein the secondary transfer backup roll includes a shaft and a rotary portion rotatable around the shaft, the shaft being securely fixed by fixing means to bosses having a predetermined height provided on the pair of side frames.

8. An image forming unit according to claim 7, wherein the secondary transfer backup roll is one of the plurality of rolls.

9. An image forming unit according to claim 7, wherein the shaft of the secondary transfer backup roll is screwed to the bosses provided on the side frames.

10. An image forming unit according to claim 7, wherein a positioner, with which a contact member rotatably fitted at both ends of a shaft of the secondary transfer roll for performing the secondary transfer is brought into contact, is formed at each side frame in the vicinity of the secondary transfer backup roll.

11. An image forming unit according to claim 10, wherein the positioner is formed in such a manner that an angle formed by a marginal edge of the positioner in contact with the contact member and a virtual line connecting the center of the shaft of the secondary transfer backup roll to the center of the shaft of the secondary transfer roll becomes acute, as viewed sideways.

12. An image forming unit according to claim 10, wherein each positioner is formed continuously to each boss.

13. An image forming unit according to claim 7, wherein the secondary transfer backup roll and the image bearing body are arranged in the proximity of each other.

14. An image forming unit according to claim 7, wherein the primary transfer member includes a lap-in roll and a lap-out roll for lapping the intermediate transfer belt on the image bearing body.

15. An image forming unit according to claim 14, wherein the secondary transfer backup roll and the image bearing body are arranged in the proximity of each other, and further, the lap-out roll is provided between the secondary transfer backup roll and the image bearing body.

16. An image forming unit according to claim 14, wherein the secondary transfer backup roll and the lap-out roll are arranged in the proximity of each other.

17. An image forming unit according to claim 16, wherein a bearing disposed in the secondary transfer backup roll and a bearing disposed in the lap-out roll are set off in an axial direction.

* * * * *